United States Patent [19]

Giller

[11] Patent Number: 4,672,514

[45] Date of Patent: Jun. 9, 1987

[54] ELECTRICAL REFLECTOR LAMP

[75] Inventor: Henricus F. J. I. Giller, Weert, Netherlands

[73] Assignee: U.S. Philips Corporation, New York, N.Y.

[21] Appl. No.: 793,882

[22] Filed: Nov. 1, 1985

[30] Foreign Application Priority Data

Nov. 9, 1984 [NL] Netherlands ..... 8403421

[51] Int. Cl.[4] ..... F21V 7/00

[52] U.S. Cl. ..... 362/297; 362/347; 313/113

[58] Field of Search ..... 362/297, 347, 307, 310, 362/329; 313/113,114; 313/113 X, 114 X

[56] References Cited

U.S. PATENT DOCUMENTS

| | | | |
|---|---|---|---|
| 2,110,590 | 3/1938 | Cook, Jr. | 362/297 |
| 2,629,046 | 2/1953 | Liberman | 362/329 |
| 4,420,801 | 12/1983 | Reiling et al. | 362/297 |
| 4,447,865 | 5/1984 | van Horn . | |
| 4,536,834 | 8/1985 | Sands et al. | 362/297 |

*Primary Examiner*—William A. Cuchlinski, Jr.
*Assistant Examiner*—D. M. Cox
*Attorney, Agent, or Firm*—David R. Treacy

[57] ABSTRACT

The electrical reflector lamp according to the invention has a blown lamp vessel (1) comprising a light-transmitting part (4) opposite to a neck-shaped part (3). The lamp vessel (1) has a first mirror-coated lamp vessel portion (5), which has a spherically curved part (14) and a paraboloidally curved part (15), and further a second mirror-coated lamp vessel portion (7), which is curved paraboloidally. A paraboloidally curved reflector (8) is arranged in the neck-shaped lamp vessel portion (3). The foci of the paraboloidal parts and the reflector and the center of the spherical part coincide (6). The light source is arranged in a plane (12) through the foci (6) and transversely to the axis of symmetry (2) of the lamp vessel (1). A very large part of the generated light is irradiated by the lamp in a concentrated beam.

3 Claims, 1 Drawing Figure

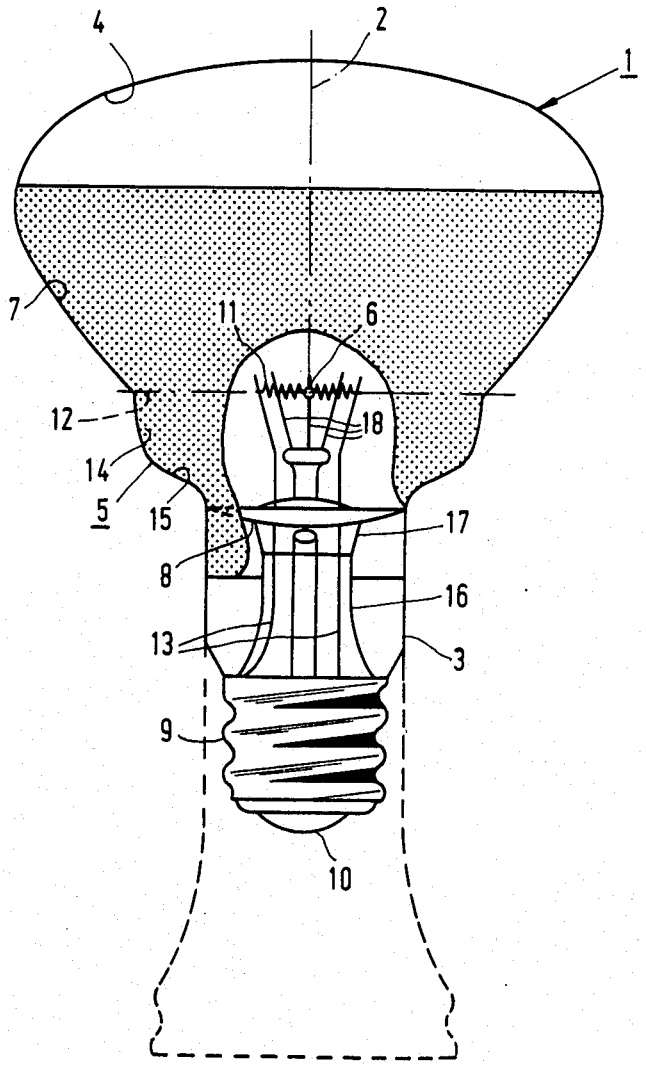
4
2
1
7
11
6
12
18
14
5
15
17
8
16
13
3
9
10

ELECTRICAL REFLECTOR LAMP

The invention relates to an electrical reflector lamp comprising a blown glass lamp vessel sealed in a vacuum-tight manner and having an axis of symmetry.

The lamp vessel has a neck-shaped lamp vessel portion opposite to a light-transmitting lamp vessel portion and further a first mirror-coated concave lamp vessel portion having a focus.

The first mirror-coated concave lamp vessel portion is connected to the neck-shaped lamp vessel portion and passes into a second mirror-coated, concave, at least substantially parabolically curved lamp vessel portion having a focus.

The second mirror-coated lamp vessel portion passes into the light-transmitting lamp vessel portion.

The reflector lamp further comprises a concave reflector arranged in the neck-shaped lamp vessel portion and having a focus which coincides at least substantially with the focus of the first mirror-coated lamp vessel portion.

A lamp base is secured to the neck-shaped lamp vessel portion and provided with contacts.

A light source is arranged in a plane passing through the foci and transversely to the axis of symmetry. Current supply conductors extend from this light source to the contacts of the lamp base.

Such a lamp is known from U.S. Pat. No. 2,110,590.

In the known lamp, the second mirror-coated lamp vessel portion has a form which is obtained by rotating a half of a parabola about an axis parallel to the axis of the parabola so that within the lamp vessel there is a circle on which the foci of the parabola portions are located.

The first mirror-coated lamp vessel portion has together with the reflector the form of a half flat ellipsoid.

The known lamp has the disadvantage that a large part of the light generated by the light source is thrown onto the ellipsoidal reflector and onto the ellipsoidal mirror and is reflected thereby to the parabolic wall portion, as a result of which this light emanates from the lamp vessel only after two reflections. Due to the imperfect reflectivity of the reflector and the mirrors, a considerable loss of light thus occurs.

The invention has for its object to provide a reflector lamp which is of a simple readily obtainable construction and which efficiently concentrates to a beam the light generated by the light source.

According to the invention, this object is achieved in a lamp of the kind described in the opening paragraph wherein the following:

The second mirror-coated lamp vessel portion is curved at least substantially paraboloidally.

The first mirror-coated lamp vessel portion has an at least substantially spherically curved part which adjoins the second mirror-coated lamp vessel portion and whose centre of curvature coincides at least substantially with the coinciding foci and which optically cooperates at least substantially with the second mirror-coated lamp vessel portion, and an at least substantially paraboloidally curved part.

The concave reflector is curved at least substantially paraboloidally.

In the lamp according to the invention, light thrown by the light source onto the paraboloidal reflector is reflected by this reflector parallel to or substantially parallel to the axis of symmetry so that after only one reflection it can emanate in the form of a beam through the light-transmitting lamp vessel portion. This also applies to light which is irradiated to the paraboloidal part of the first mirror-coated lamp vessel portion. The light thrown onto the spherically curved part is not lost, but is reflected to the second mirror-coated lamp vessel portion and then contributes to the light concentrated to a beam and irradiated by the lamp.

The lamp according to the invention is of a simple and readily obtainable construction. The lamp only requires a lamp vessel blown into a special shape and a reflector in the neck-shaped lamp vessel portion. Thus, the invention provides a lamp which effectively concentrates the generated light to a beam and which nevertheless has only a low cost price. This holds especially if the free end of the neck-shaped lamp vessel portion is fused with a tube which extends in this lamp vessel portion and which has at its end located within the lamp vessel a pinch on which the reflector is clamped.

An embodiment of the lamp according to the invention will now be described, by way of example, with reference to the accompanying drawing which shows the lamp in side elevation, partly broken away.

Referring to the drawing, the lamp has a blown glass lamp vessel 1 sealed in a vacuum-tight manner and having an axis of symmetry 2. The lamp vessel 1 has a neck-shaped lamp vessel portion 3 opposite to a light-transmitting lamp vessel portion 4.

A first mirror-coated, concave lamp vessel portion 5 is connected to the neck-shaped lamp vessel portion 3. It, has a focus 6 and passes into a second mirror-coated, concave, at least substantially paraboloidally curved lamp vessel portion 7, which also has a focus 6 and passes into the light transmitting lamp vessel portion 4.

A concave reflector 8 with a focus 6 is arranged in the neck-shaped lamp vessel portion 3. The foci 6 of the reflector 8 and vessel portion 3 coincide at least substantially at focus 6.

A lamp base 9 is secured to the neck-shaped lamp vessel portion 3. It has a first contact 10 and has in the embodiment shown a sheath as its second contact.

A light source 11 is arranged in a plane 12 through the focus 6 and transverse to the axis of symmetry 2. Current supply conductors 13 extend from this light source 11 to the contacts of the lamp base 9.

The second mirror-coated lamp vessel portion 7 is paraboloidally shaped as a function of the equation $y^2=(4)\cdot(14)\cdot x(\mathrm{mm}^2)$.

The first mirror-coated lamp vessel portion 5 has a spherically curved part 14 having a radius of 28 mm. Its centre of curvature coincides at least substantially with focus 6. The spherical part 14 optically cooperates at least substantially with the second mirror-coated lamp vessel portion 7. The lamp vessel portion 5 further has an at least substantially paraboloidally curved part 15, whose focus also coincides with focus 6. In the FIGURE, curved part 15 is parabolically shaped as a function of the equation $y^2=(4)\cdot(20)\cdot x(\mathrm{mm}^2)$.

The concave reflector 8 is curved at least substantially paraboloidally, as a function of the equation $y^2=(4)\cdot(25)\cdot x(\mathrm{mm}^2)$, having a focus coinciding with focus 6. The reflector consists of aluminum.

The lamp shown is mirror-coated by locally depositing aluminium vapor.

A tube 16 is fused with the free end of the neck-shaped lamp vessel portion 3 and extends in this lamp vessel portion 3. Tube 16 has at its end a pinch 17 located within the lamp vessel 1 Reflector 8 is clamped on punch 17.

The filament 11 is arranged in a compact manner by means of the current supply conductors 13 and three supports 18. It has the shape of a V with bent limbs.

The reflecting parts of the lamp together collect about 68% of the generated light. The remaining part is thrown by the filament directly onto the light-transmitting lamp vessel portion 4. About 60% of the generated light reaches directly or indirectly a paraboloidally curved reflecting surface.

The light-transmitting wall portion 4 may be slightly satin-frosted, but even if this is not the case the lamp still yields a very uniform beam of light.

In a particular embodiment, the lamp vessel is given during blowing a profile on the outer side of the lamp vessel portion 4.

The lamp vessel portion 4 may be, for example, red-colored.

In the FIGURE, the blown bulb from which the lamp vessel was obtained is indicated in dotted lines.

What is claimed is:

1. An electrical reflector lamp comprising:

(a) a blown glass lamp vessel sealed in a vacuum-tight manner and having an axis of symmetry, said blown glass lamp vessel having a neck-shaped lamp vessel portion opposite to a light-transmitting lamp vessel portion;

(b) a lamp base secured to said neck-shaped lamp portion and having electrical contacts;

(c) a concave reflector arranged in said neck-shaped lamp vessel portion, and having a substantially parabolic shape with its focus substantially at a predetermined focal point;

(d) a light source disposed within said blown glass lamp vessel, and having current supply conductors extending therefrom and coupled to said contacts of said lamp base, said light source being arranged with its geometric center disposed substantially on said axis of symmetry of said blown glass lamp vessel;

(e) a first mirror-coated concave lamp vessel portion being connected to said neck-shaped portion of said blown glass lamp vessel portion, said first concave lamp vessel portion having a substantially parabolic reflector part with its focus at substantially said predetermined focal point, said parabolic reflector part adjoining said neck-shaped portion, and said first concave lamp vessel portion also having a substantially spherical reflector part with its center of curvature at substantially said predetermined focal point;

(f) a second mirror-coated concave lamp vessel portion being connected to said light-transmitting lamp vessel portion and adjoining said spherical reflector part of said first concave lamp vessel portion, said second concave lamp vessel portion having a substantially parabolical reflector part with its focus at substantially said predetermined focal point;

(g) said spherical reflector part of said first concave lamp vessel portion optically cooperating with said parabolical reflector part of said second concave lamp vessel portion to re-reflect light emanating from said light source.

2. An electrical reflector lamp as claimed in claim 1, and further comprising a tube which extends in said neck-shaped lamp vessel portion and is fused to a free end of said neck-shaped lamp vessel portion, said tube having at its end located within said neck-shaped lamp vessel a pinch, and said concave reflector being mounted on said pinch.

3. An electrical reflector lamp according to claim 1, wherein said light source extends transverse to said axis of symmetry of said blown glass lamp vessel.

* * * * *